US010301944B2

(12) United States Patent
Buchholz et al.

(10) Patent No.: US 10,301,944 B2
(45) Date of Patent: May 28, 2019

(54) TURBINE BLADE

(71) Applicant: Siemens Aktiengesellschaft, Munich (DE)

(72) Inventors: Björn Buchholz, Dinslaken (DE); Ralph Gossilin, Oberhausen (DE); Daniela Koch, Berlin (DE); Marco Schüler, Potsdam (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/739,299

(22) PCT Filed: Jun. 21, 2016

(86) PCT No.: PCT/EP2016/064274
§ 371 (c)(1),
(2) Date: Dec. 22, 2017

(87) PCT Pub. No.: WO2017/005484
PCT Pub. Date: Jan. 12, 2017

(65) Prior Publication Data

US 2018/0187551 A1 Jul. 5, 2018

(30) Foreign Application Priority Data

Jul. 3, 2015 (EP) ..... 15175301

(51) Int. Cl.
*F01D 5/14* (2006.01)
*F01D 9/04* (2006.01)

(52) U.S. Cl.
CPC ..... *F01D 5/147* (2013.01); *F01D 5/14* (2013.01); *F01D 9/041* (2013.01);
(Continued)

(58) Field of Classification Search
CPC ..... F01D 5/14; F01D 5/147; F01D 5/141; F01D 5/143; F01D 5/18; F01D 5/187;
(Continued)

(56) References Cited

U.S. PATENT DOCUMENTS 2,861,775 A 11/1958 Whitehead
6,019,579 A 2/2000 Fukuno et al.
(Continued)

FOREIGN PATENT DOCUMENTS

CN 101213353 A 7/2008
CN 101627182 A 1/2010
(Continued)

OTHER PUBLICATIONS

IPEA (PCT/IPEA/416 and 409) dated Nov. 6, 2017, for PCT/EP2016/064274.
(Continued)

*Primary Examiner* — Carlos A Rivera
*Assistant Examiner* — Justin A Pruitt
(74) *Attorney, Agent, or Firm* — Beusse Wolter Sanks & Maire

(57) ABSTRACT

A cast turbine blade having a platform and hollow blade airfoil arranged thereon, wherein the blade airfoil has a pressure-side blade wall and a suction-side blade wall that extend, along a centrally arranged curved profile centerline, from a common leading edge to a common trailing edge, and having a transition, with an outer contour profile, between the blade airfoil and the platform. The blade walls each have a locally determined blade wall thickness, wherein the turbine blade has, internally, a contour profile that partially matches the outer contour profile of the transition such that the region of the transition has an essentially constant blade wall thickness. In the transition, the contour profile at a surface section of the blade airfoil facing the leading edge is
(Continued)

such that the blade wall thickness is increased there in comparison to the blade wall thickness of the transition away from the leading edge.

9 Claims, 2 Drawing Sheets

(52) U.S. Cl.
CPC ..... *F05D 2220/32* (2013.01); *F05D 2230/21* (2013.01); *F05D 2240/12* (2013.01); *F05D 2240/301* (2013.01); *F05D 2240/80* (2013.01)

(58) Field of Classification Search
CPC .. F01D 9/041; F05D 2220/32; F05D 2230/21; F05D 2240/12; F05D 2240/301; F05D 2240/303; F05D 2240/80
USPC ..... 415/191
See application file for complete search history.

(56) References Cited

U.S. PATENT DOCUMENTS

| | | | |
|---|---|---|---|
| 2001/0016163 | A1 | 8/2001 | Tomita et al. |
| 2004/0109765 | A1 | 6/2004 | Benedetti et al. |
| 2005/0106011 | A1 | 5/2005 | Tiemann |
| 2006/0275112 | A1* | 12/2006 | Lee ..... F01D 5/143 415/191 |
| 2008/0152501 | A1 | 6/2008 | Greim et al. |
| 2008/0232971 | A1 | 9/2008 | Ahmad et al. |
| 2009/0035128 | A1 | 2/2009 | Ahmad |
| 2011/0076155 | A1 | 3/2011 | Hofmann et al. |
| 2012/0269615 | A1 | 10/2012 | Kuwabara |
| 2013/0004321 | A1 | 1/2013 | Yokoyama et al. |

FOREIGN PATENT DOCUMENTS

| | | | |
|---|---|---|---|
| CN | 101213353 | B | 12/2011 |
| CN | 102378849 | A | 3/2012 |
| EP | 1355041 | A2 | 10/2003 |
| EP | 2476863 | A1 | 7/2012 |
| GB | 2395987 | A | 6/2004 |
| JP | 2001271603 | A | 10/2001 |
| JP | 2004183656 | A | 7/2004 |
| JP | 2007182777 | A | 7/2007 |
| JP | 2008051104 | A | 3/2008 |
| WO | 2007012592 | A1 | 2/2007 |
| WO | 2009118235 | A2 | 10/2009 |
| WO | 2012144244 | A1 | 10/2012 |
| WO | 2012172099 | A1 | 12/2012 |

OTHER PUBLICATIONS

EP Search Report dated Jan. 22, 2016, for EP patent application No. 15175301.9.
International Search Report dated Oct. 17, 2016, for PCT/EP2016/064274.

* cited by examiner

TURBINE BLADE

CROSS REFERENCE TO RELATED APPLICATIONS

This application is the US National Stage of International Application No. PCT/EP2016/064274 filed Jun. 21, 2016, and claims the benefit thereof. The International Application claims the benefit of European Application No. EP15175301 filed Jul. 3, 2015. All of the applications are incorporated by reference herein in their entirety.

FIELD OF INVENTION

The invention relates to a turbine blade.

BACKGROUND OF INVENTION

Hollow turbine blades, in particular gas turbine blades, have, in the region of a transition from the blade airfoil to the platform, a curvature, necessary in terms of loading and casting, on an outer surface, wherein accumulations of material arise locally in this fillet-like transition on account of a rectilinear inner design of the cooling ducts provided in the interior, said accumulations of material being harder to cool by a cooling medium that is able to flow there. Such turbine blades are known for example from U.S. Pat. No. 6,019,579 and from WO 2007/012592, wherein the latter proposes cooling the accumulations of material by providing local cooling-air ducts. Furthermore, the document U.S. Pat. No. 2,861,775 shows a turbine blade produced from bent metal sheets.

A turbine blade having a longer service life is additionally known from EP 1 355 041 A1, wherein the contour of the transition from the blade airfoil to the platform in the blade interior is adapted in order to obtain a blade-airfoil wall thickness, even in the transition region, which corresponds approximately to the wall thickness of the rest of the blade airfoil. In that case, the contour is adapted along the entire, closed periphery, i.e. along the platform. The reduced wall thickness can have a negative effect on the service life of the turbine blade for strength reasons, however, this being undesired.

SUMMARY OF INVENTION

Therefore, it is an object of the invention to indicate a cast turbine blade in which the transition region from the blade airfoil to the platform continues to be sufficiently coolable with an increased service life being achieved.

The object is achieved according to the invention by a turbine blade having the features specified in the independent claim. Advantageous configurations are presented in the dependent claims, the features of which can be combined with one another as desired.

According to the invention, provision is made, for a turbine blade corresponding to the preamble, for it to have, in the region of the transition, an inner face bounding a cavity, the contour of said inner face being adapted to the inner face in a first portion in such a way that there is a substantially uniform blade wall thickness in the region of the transition, wherein, in the transition, the contour profile of the inner face on a second inner-face portion, located opposite the leading edge, of the blade airfoil is such that the blade wall thickness is increased there compared with the blade wall thickness of the transition of the first portion of the inner face. In other words: in the transition, the contour profile on an inner-face portion, located opposite the leading edge, of the blade airfoil is such that the blade wall thickness is increased there compared with the blade wall thickness of the transition, away from the local inner-face portion.

Thus, the turbine blade has, in its interior, at the level of the platform, a contour which is different around the periphery of the cavity. In the region of the leading edge, the inner contour of the cavity tends to be rectilinear along a radial axis of a gas turbine equipped therewith and is aligned with that inner face which is located opposite the leading edge away from the transition. In this way, the inner contour avoiding the accumulations of material is present only in those regions of the blade airfoil that can be found further downstream of the leading edge.

Advantageously, the second inner-face portion with an increased blade wall thickness extends, starting at the leading edge of the blade airfoil, along the suction-side wall and/or the pressure-side wall, along the profile centerline, to a position which is less than or equal to 9% of the length of the profile centerline.

With the invention, the strength, in particular in the leading-edge region of the turbine blade, can be increased locally, resulting in an increased service life of the regions in question.

It has been found to be particularly advantageous for the platform to have a platform wall thickness and the blade airfoil, away from the transition, to have a blade wall thickness, wherein, in the region with a substantially uniform blade wall thickness of the transition, the ratio of blade wall thickness to platform wall thickness is between 0.5 and 1.

Such a turbine blade can be cooled particularly homogeneously, thereby reducing thermomechanical stresses in the material of the turbine blade.

BRIEF DESCRIPTION OF THE DRAWINGS

Exemplary embodiments of the invention are illustrated in the following figures.

In all the figures, identical features are provided with the same reference signs.

In the figures:

FIG. 1 shows a plan view of the root region of a turbine blade configured as a guide vane, and FIG. 2 shows a longitudinal section through the turbine blade according to FIG. 1, along the section line II-II.

DETAILED DESCRIPTION OF INVENTION

Figure 1:
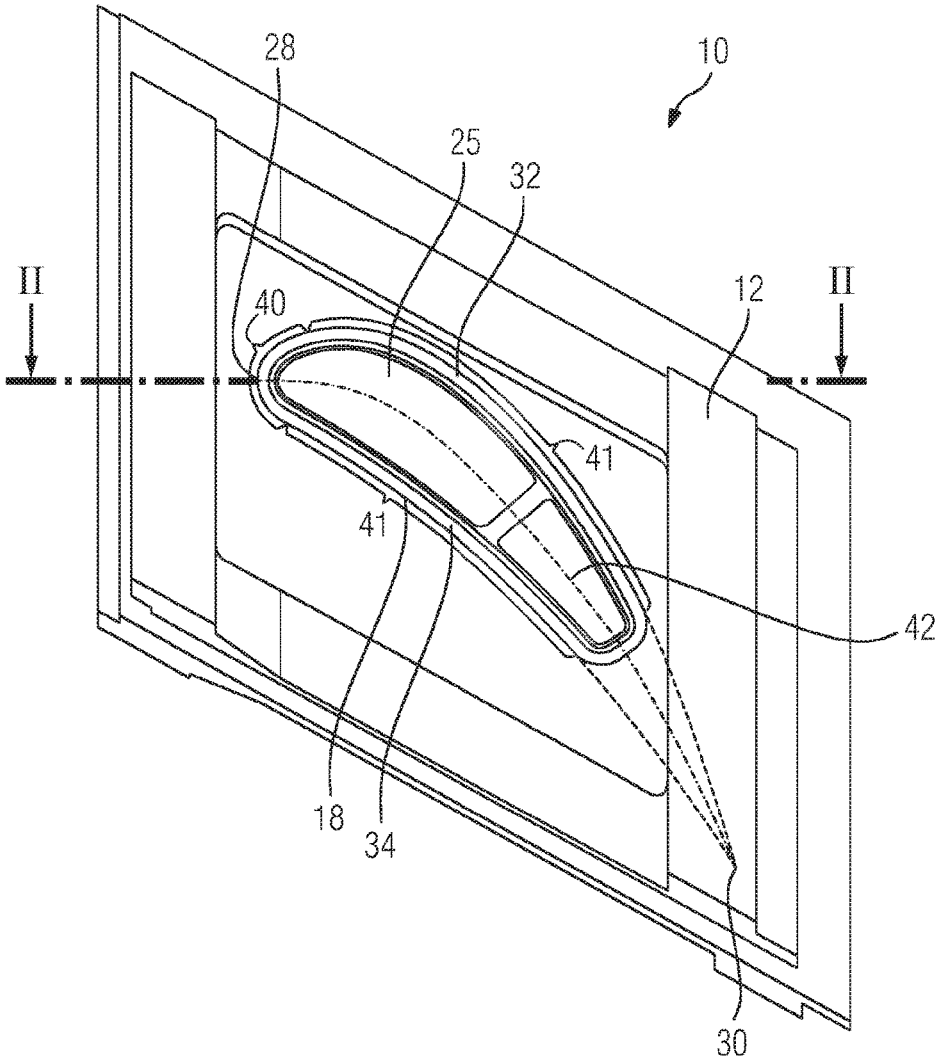
Figure 2:
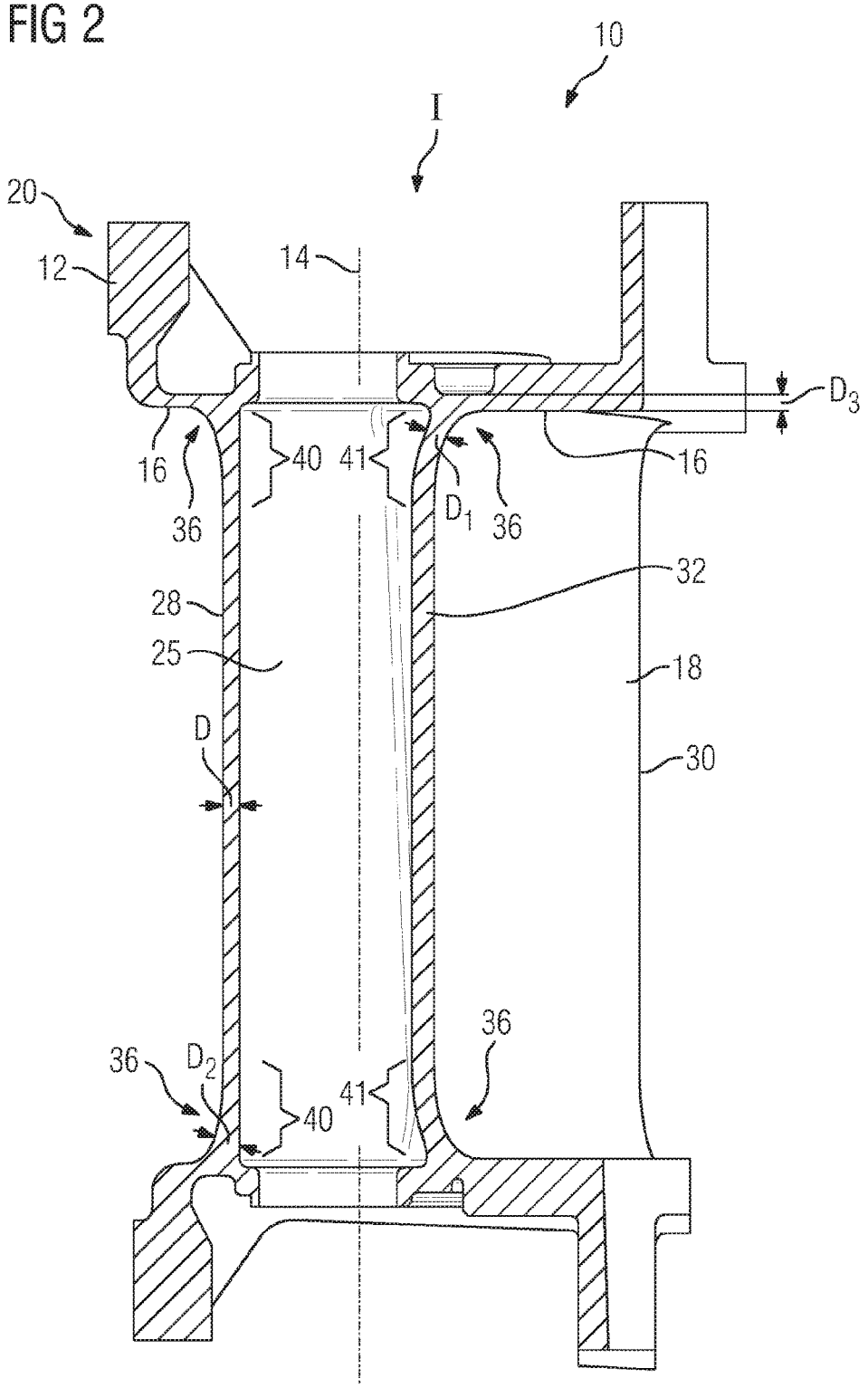

FIG. 1 shows a perspective view of a turbine blade 10. The perspective has been selected such that the plan view of a fastening region 12 of the turbine blade 10 configured as a guide vane is illustrated. FIG. 2 shows the longitudinal section through the turbine blade 10 on the section line II-II in FIG. 1. The turbine blade 10 has, in succession along a radial axis 14, the fastening region 12, a blade platform 16 adjoining the latter, and a blade airfoil 18. Formed in the fastening region 12 is a blade root 20 which serves for fastening the turbine blade 10 to a turbine guide vane support (not illustrated).

The invention is illustrated for example by way of a turbine blade configured as a guide vane with two platforms. Nevertheless, other configurations are possible, and in particular, the turbine blade can also be configured as a rotor blade of a turbine. At least the main body of the turbine blade is produced by a casting process and comprises at least the blade airfoil 18 and at least one platform 16.

As is apparent from the figures, the turbine blade 10 according to the invention, and in particular the blade airfoil 18 thereof, is embodied in a hollow manner on the inside, such that it comprises a cavity 25, which can be configured in a known manner as a cooling duct with or without impingement cooling.

The blade airfoil 18 extends from a leading edge 28 to a trailing edge 30. In this case, the blade airfoil 18 comprises a suction-side blade wall 32 (indicated only schematically in FIG. 1) and a pressure-side blade wall 34. In the radial direction 14, the blade walls 32, 34 have a wall thickness D which is substantially constant.

On account of the production process, there is a transition 36 between the blade airfoil 18 and the platform 16, said transition 36 being rounded on the outer surface of the turbine blade 10 and thus being in the form of a fillet.

On the inside, the blade airfoil 18 has an inner face located opposite the outer faces. This is in such a way in the region of the suction-side blade wall 32 that it is partially adapted to the outer contour profile of the transition, i.e. along the radial axis 14 from a blade tip to the blade root, such that there is a substantially uniform blade wall thickness $D_1$ in the transition 36 there, too.

The inner face in the region of the transition 36 comprises a second inner-face portion 40, located opposite the leading edge 28, the contour profile of which is such that the blade wall thickness $D_2$ is increased there compared with the blade wall thickness $D_1$ of the transition away from the second inner-face portion 40. In other words: the second inner-face portion 40 is located only in the immediate vicinity of the leading edge and forms a straight line with the inner face of the rest of the blade airfoil, as seen in the radial direction 14 or in longitudinal section, whereas the rest of the inner face of the suction and/or pressure side is curved in the transition, i.e. a first inner-face portion 41, with an approximately uniform blade wall thickness $D_1$ being maintained. Thus, starting from the leading edge 28, along the transition 36, the second inner-face portion 40 with the increased wall thickness $D_2$ is followed by the first inner-face portion 41 with a wall thickness $D_1$ which corresponds to the wall thickness D of the blade airfoil.

As a result, a transition region of a turbine blade 10 that is thickened in the region of the leading edge 28 can be provided, said transition region having greater stiffness than in the remaining region. This can improve the service life of the turbine blade 10.

Overall, the invention relates to a cast turbine blade 10 having a platform 16 and having a hollow blade airfoil 18 arranged thereon, wherein the blade airfoil 18 comprises a pressure-side blade wall 34 and a suction-side blade wall 32 which extend along a centrally arranged curved profile centerline 42 from a common leading edge 28 to a common trailing edge 30, and having a transition 36, exhibiting an external contour profile, between the blade airfoil and the platform 16, wherein the blade walls 32, 34 each have a blade wall thickness D to be determined locally, wherein the turbine blade has, on the inside, a contour profile which is partially adapted to the outer contour profile of the transition 36 in such a way that there is a substantially uniform blade wall thickness in the region of the transition 36. In order to further improve the service life of such a turbine blade, the invention provides that, in the transition 36, the contour profile on a second inner-face portion 40, located opposite the leading edge 28, of the blade airfoil is such that the blade wall thickness is increased there compared with the blade wall thickness of the transition away from the leading edge.

The invention claimed is:

1. A cast, hollow turbine blade, comprising:

a platform, and a hollow blade airfoil arranged thereon, wherein the blade airfoil comprises a pressure-side blade airfoil wall and a suction-side blade airfoil wall which extend along a centrally arranged curved profile centerline from a common leading edge to a common trailing edge, and having a transition, exhibiting an external contour profile, between the blade airfoil and the platform, wherein the blade walls each have a blade wall thickness (D) to be determined locally, wherein the turbine blade has, in the region of the transition, an inner face bounding a cavity, the contour of said inner face being adapted to the inner face in a first portion in such a way that there is a substantially uniform blade wall thickness (D1) in the region of the transition, wherein in the transition, the contour profile of the inner face on a second inner-face portion, located opposite the leading edge, of the blade airfoil is such that the blade wall thickness (D2) is increased there compared with the blade wall thickness (D1) of the transition of the first portion of the inner face.

2. The turbine blade as claimed in claim 1, wherein the contour profile in the second inner-face portion is rectilinear along a radial axis.

3. The turbine blade as claimed in claim 1, wherein the platform has a platform wall thickness (D3) and the blade airfoil, away from the second inner-face portion, has a blade wall thickness (D), wherein, in the region with a substantially uniform blade wall thickness, the ratio (D/D3) of blade wall thickness (D) to platform wall thickness (D3) is between 0.5 and 1.

4. The turbine blade as claimed in claim 1, wherein the second inner-face portion with an increased blade wall thickness (D2) extends from the leading edge along the suction-side wall and/or along the pressure-side wall, along the profile centerline, to a position which is less than 15% of the length of the profile centerline.

5. The turbine blade as claimed in claim 1, which is configured as a turbine guide vane.

6. A cast, hollow turbine blade, comprising:

a platform, an airfoil arranged on the platform, comprising an airfoil inner surface and an airfoil outer surface and defining a pressure side wall and a suction side wall of the airfoil, a cavity within the airfoil and bounded by the airfoil inner surface, and a transition between the airfoil and the platform and characterized internally by a radially oriented internal contour profile of the airfoil inner surface and externally by a radially oriented external contour profile of the airfoil outer surface, wherein in a first region of the transition remote from a leading edge of the airfoil the internal contour profile curves with the external contour profile to provide an airfoil wall thickness in the first region, wherein in a second region of the transition disposed at the leading edge the internal contour profile is different than the internal contour profile in the first region, and the difference is effective to provide a greater airfoil wall thickness in the second region than in the first region.

7. The turbine blade of claim 6, wherein the turbine blade defines a radial axis from a base to a tip of the turbine blade, wherein the internal contour profile in the first region diverges from the radial axis more than does the internal contour profile in the second region.

8. The turbine blade of claim 6, wherein the turbine blade defines a radial axis from a base to a tip of the turbine blade, wherein the transition comprises a fillet between the airfoil outer surface and the platform in both the first region and the second region, and wherein the internal contour profile in the second region is rectilinear where radially aligned with a curvature of the fillet.

9. The turbine blade of claim 8, wherein the internal contour profile in the second region is rectilinear along the radial axis.

* * * * *